US012534913B2

(12) United States Patent
Yin et al.

(10) Patent No.: US 12,534,913 B2
(45) Date of Patent: Jan. 27, 2026

(54) PRE-FABRICATED REINFORCEMENT CAGE STRUCTURE AND METHOD OF HOISTING AND ASSEMBLING THE SAME

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Jhih-Syuan Chen, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 189 days.

(21) Appl. No.: 18/515,053

(22) Filed: Nov. 20, 2023

(65) Prior Publication Data

US 2024/0183158 A1 Jun. 6, 2024

(30) Foreign Application Priority Data

Dec. 1, 2022 (TW) ..... 111146163

(51) Int. Cl.
*E04C 5/16* (2006.01)
*E04C 5/06* (2006.01)

(52) U.S. Cl.
CPC ..... *E04C 5/163* (2013.01); *E04C 5/0613* (2013.01); *E04C 5/0604* (2013.01)

(58) Field of Classification Search
CPC ..... E04C 5/06; E04C 5/0604; E04C 5/0609; E04C 5/0613; E04C 5/0618; E04C 5/0622; E04C 5/0627; E04C 5/0631; E04C 5/0636; E04C 5/064; E04C 5/0645; E04C 5/12; E04C 5/122; E04C 5/125; E04C 5/162; E04C 5/163; E04C 5/165; E04C 5/167; E04C 5/168
See application file for complete search history.

(56) References Cited

U.S. PATENT DOCUMENTS 2,988,794 A * 6/1961 Gutt ..... E04C 5/125 52/223.13
3,592,243 A * 7/1971 Fukushima ..... B21F 27/122 140/112

(Continued)

FOREIGN PATENT DOCUMENTS

CN 105518234 A 4/2016

*Primary Examiner* — Kyle J. Walraed-Sullivan
(74) *Attorney, Agent, or Firm* — Juan Carlos A. Marquez; Marquez IP Law Office, PLLC

(57) ABSTRACT

A pre-fabricated reinforcement cage structure and a method of hoisting and assembling the same are provided. The pre-fabricated reinforcement cage structure comprises: a pre-fabricated reinforcement cage, a plurality of couplers, and a first rebar-mounting frame. The first rebar-mounting frame comprises a first top, a first bottom plate and a first lateral plate. The first top has a plurality of notches formed along an edge of the first top plate, and each of the plurality of notches is configured to receive a first end portion of the corresponding one of the plurality of rebars in the pre-fabricated reinforcement cage. A first end portion of each of the plurality of rebars abuts against a first top surface of the first bottom plate. Each of the first top plate and the bottom plate is connected to the first lateral plate.

13 Claims, 14 Drawing Sheets

(56) References Cited

U.S. PATENT DOCUMENTS

| | | | | |
|---|---|---|---|---|
| 3,716,210 | A * | 2/1973 | Fukushima | E04C 5/0618 245/1 |
| 4,377,928 | A * | 3/1983 | Hasak | E04C 5/0618 52/649.4 |
| 4,833,857 | A * | 5/1989 | Wheeler | E04C 5/208 52/649.8 |
| 6,233,893 | B1 * | 5/2001 | Lewis | E04C 5/04 52/745.19 |
| 7,374,369 | B2 * | 5/2008 | Jakubowski | E02D 27/42 52/223.4 |
| 8,375,678 | B1 * | 2/2013 | Ferrer | E04C 5/0604 52/649.3 |
| 8,387,329 | B2 * | 3/2013 | Stevens | E04C 5/0604 52/649.3 |
| 9,267,287 | B1 * | 2/2016 | Bongiorno | E04C 5/0604 |
| 9,890,545 | B1 * | 2/2018 | Bongiorno | E04C 5/0618 |
| 2015/0113886 | A1 * | 4/2015 | Chang | E04C 5/168 52/745.19 |
| 2016/0251856 | A1 * | 9/2016 | Kim | E04C 3/34 52/231 |
| 2017/0081853 | A1 * | 3/2017 | Kim | E04C 5/165 |
| 2018/0044919 | A1 * | 2/2018 | Moore | B25B 11/02 |
| 2018/0291612 | A1 * | 10/2018 | Zavitz | E04B 1/5837 |
| 2019/0257094 | A1 * | 8/2019 | Zhang | E04C 3/20 |
| 2023/0110083 | A1 * | 4/2023 | Wu | E04C 5/0609 52/677 |
| 2023/0110325 | A1 * | 4/2023 | Wu | E04C 5/0622 52/677 |
| 2023/0115539 | A1 * | 4/2023 | Wu | E04C 5/0622 52/677 |
| 2024/0254769 | A1 * | 8/2024 | Andersen | E04C 3/34 |

* cited by examiner

PRE-FABRICATED REINFORCEMENT CAGE STRUCTURE AND METHOD OF HOISTING AND ASSEMBLING THE SAME

BACKGROUND

Field of the Invention

The instant disclosure relates to a reinforcement cage structure and a method for hoisting and assembling the same, and in particular, to a pre-fabricated reinforcement cage structure and a method for hoisting and assembling the same.

Description of Related Art

In constructing a building with several floors, the column steel bars in columns at different floors of the building need to be connected to enhance the strength of the building. In a conventional construction method, where a floor of a building has been constructed, the tops of the column steel bars of the columns beneath the floor are exposed to the floor, and couplers are used for manually connecting the exposed tops of the column steel bars of the columns beneath the floor to the bottoms of the column steel bars of the columns on the floor. The drawbacks of this conventional construction method are its time-consuming nature and the difficulty in making precise connections between the steel bars.

FIG. 12A and FIG. 12B show another prior art in which each of a plurality of rebars 60 is connected to each of the corresponding to-be-connected rebars 70. A lower end portion of some rebar 60 has a male threaded section 61, and an upper end portion of some corresponding to-be-connected rebar 70 has a sleeve 71 having a female threaded section in its inner circumference. When an operator manually screws the male threaded sections 61 of the rebars 60 into the female threaded sections of the sleeves 71 of the to-be-connected rebars 70, one by one, to connect the rebars 60 to the to-be-connected rebars 70, a deviation in a transverse direction or in a vertical direction may be caused during the connection of the rebars, resulting in skewing of the rebars 60 in a reinforcement cage after the connection, as shown in FIG. 12B, which requires a plurality of manual adjustments to remedy the deviation, which is quite time-consuming.

In view of the disadvantages of the above conventional construction methods, this application is intended to provide a pre-fabricated reinforcement cage structure and a method for hoisting and assembling the same, which not only can realize a quality construction precision in the transverse direction and in the vertical direction for the column rebar connection without excessive reliance on manual adjustments, but also can expedite the hoisting and assembling of the pre-fabricated reinforcement cage.

SUMMARY OF THE INVENTION

According to one exemplary embodiment of the instant disclosure, a pre-fabricated reinforcement cage structure is provided. The pre-fabricated reinforcement cage structure comprises: a pre-fabricated reinforcement cage, a plurality of couplers, and a first rebar-mounting frame. The pre-fabricated reinforcement cage includes a plurality of rebars; and a plurality of stirrups binding to the outer circumferences of and fixed to the plurality of rebars, wherein the plurality of stirrups are spaced apart along a length direction of the rebars so that the plurality of the rebars are substantially parallel to each other. Each of the plurality of couplers threadedly engages with a first end of each of the plurality of the rebars. The first rebar-mounting frame is configured to be engaged with the plurality of couplers so that the first end of each of the plurality of the rebars is held by the first rebar-mounting frame, wherein the first rebar-mounting frame comprises a first top, a first bottom plate and a first lateral plate. The first top has a plurality of notches formed along an edge of the first top plate, and each of the plurality of the notches is configured to receive the first end portion of the corresponding one of the plurality of the rebars. The first end portion of each of the plurality of rebars abuts against a first top surface of the first bottom plate. Each of the first top plate and the bottom plate is connected to the first lateral plate.

According to another exemplary embodiment of the instant disclosure, a method of hoisting and assembling a pre-fabricated reinforcement cage structure is provided. The method comprises the following steps: step (a): providing a pre-fabricated reinforcement cage, the pre-fabricated reinforcement cage comprising: a plurality of rebars; and a plurality of stirrups binding to the outer circumferences of and fixed to the plurality of rebars, the plurality of stirrups being spaced apart along a length direction of the rebars so that the plurality of the rebars are substantially parallel to each other; step (b): providing a first rebar-mounting frame comprising: a first top plate having a plurality of notches formed along an edge of the first top plate; a first bottom plate, wherein a first end portion of each of the plurality of rebars abuts against a first top surface of the first bottom plate; and a first lateral plate to which each of the first top plate and the bottom plate is connected; step (c): inserting the first end portion of each of the plurality of the rebars into each of the corresponding notches of the first rebar-mounting frame, and detachably securing the first end portion of each of the plurality of the rebars to the first rebar-mounting frame through a coupler, thereby aligning the first end surfaces of the first end portions of the plurality of the rebars; step (d) providing a second rebar-mounting frame and detachably securing the second rebar-mounting frame to a second end portion of each of the rebars opposite to the first end portion of the same, the second rebar-mounting frame comprising at least one hook or hoist-ring mounted thereon; step (e): hoisting the pre-fabricated reinforcement cage structure to above a plurality of to-be-connected rebars; and step (f): removing the first rebar-mounting frame from the pre-fabricated reinforcement cage structure and then adjusting a position of the pre-fabricated reinforcement cage structure so that each of the plurality of the rebars of the pre-fabricated reinforcement cage structure is respectively aligned with and contacts the corresponding one of the plurality of the to-be-connected rebars; and step (g): connecting and securing each of the plurality of the rebars of the pre-fabricated reinforcement cage structure to the corresponding one of the plurality of the to-be-connected rebars through the coupler coupled to each of the plurality of rebars of the pre-fabricated reinforcement cage structure.

BRIEF DESCRIPTION OF THE DRAWINGS

The present disclosure as well as a preferred mode of use, further objectives, and advantages thereof will be best understood by referring to the following detailed description of illustrative embodiments in conjunction with the accompanying drawings, wherein.

DETAILED DESCRIPTION OF THE PREFERRED EMBODIMENTS

Figure 1:
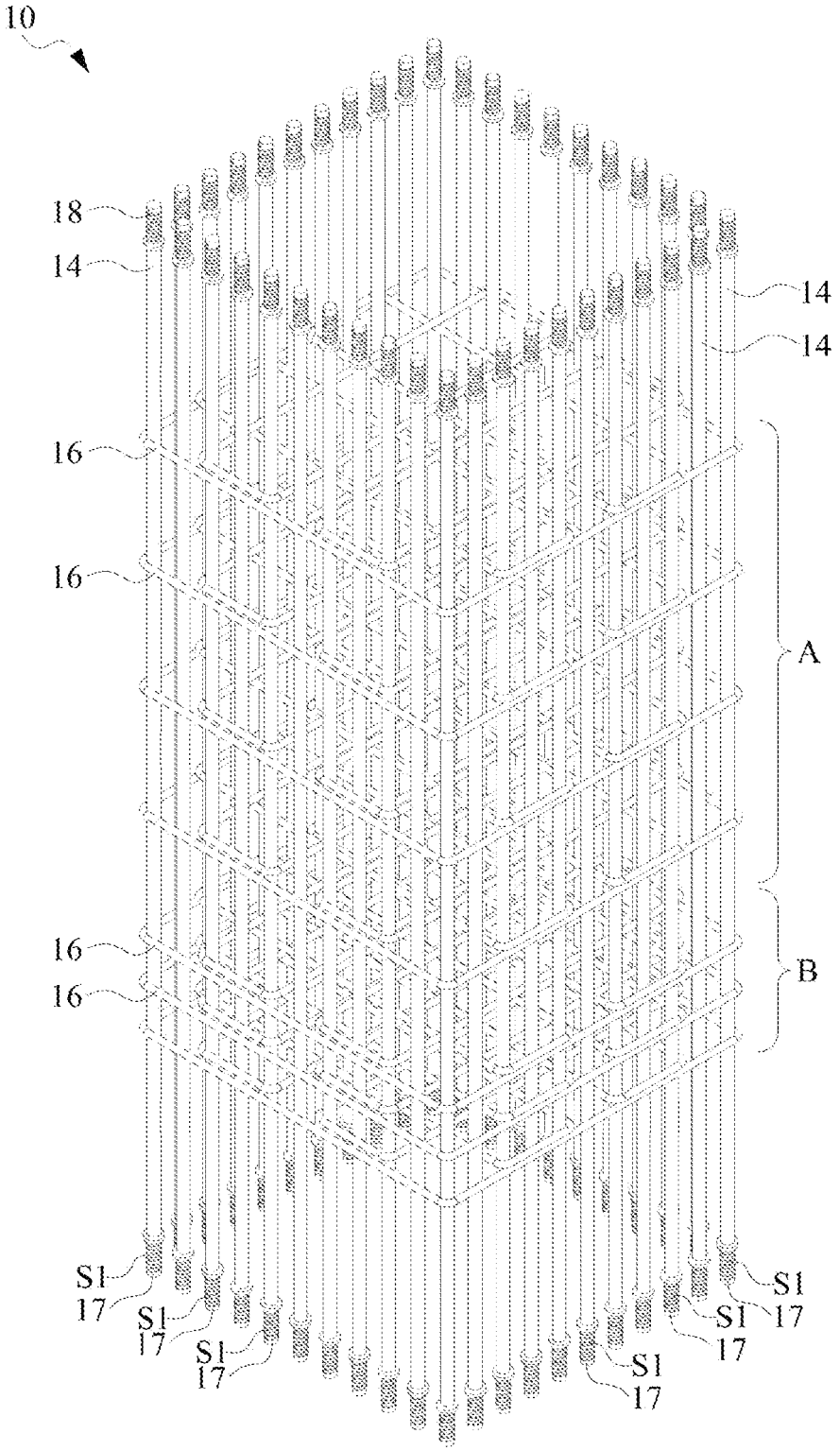
FIG. 1 is a schematic view of a pre-fabricated reinforcement cage according to an exemplary embodiment of this application.

The characteristics, subject matter, advantages, and effects of the present disclosure are detailed hereinafter by reference to embodiments of the present disclosure and the accompanying drawings. It is understood that the drawings referred to in the following description are intended only for purposes of illustration, and do not necessarily show the actual proportion and precise arrangement of the embodiments. Therefore, the proportion and arrangement shown in the drawings should not be construed as limiting or restricting the scope of the present disclosure.

FIG. 1 is a schematic view showing a pre-fabricated reinforcement cage according to an exemplary embodiment of this application. As shown in FIG. 1, a pre-fabricated reinforcement cage 10 comprises a plurality of rebars 14 and a plurality of stirrups 16. The plurality of stirrups 16 are respectively bound to the outer circumferences of and are secured to the plurality of rebars 14. The plurality of stirrups are spaced apart along a length direction of the rebars 14 so that the plurality of the rebars 14 are held substantially parallel to each other. In this embodiment, in an area A of the pre-fabricated reinforcement cage 10 shown in FIG. 1, the plurality of stirrups 16 are respectively bound to the outer circumferences of the plurality of rebars 14 and are respectively secured to the plurality of rebars 14 through, for example, welding, or tying. In addition, in an area B, the plurality of stirrups 16 are also bound to the outer circumferences of the plurality of rebars 14, but are loosely tied to the plurality of rebars 14. In addition, the pitch between each adjacent two of the plurality of stirrups 16 in the region B is smaller than that between each adjacent two of the plurality of stirrups 16 in the area A.

As shown in FIG. 1, area A occupies a large part of the pre-fabricated reinforcement cage 10 in the height direction. Therefore, through welding or tying of the plurality of stirrups 16 to the rebars 14 in the area A, the relative positions between the plurality of rebars 14 of the pre-fabricated reinforcement cage 10 can be secured. Under this arrangement, the rigidity of the pre-fabricated reinforcement cage 10 is sufficient for preventing the pre-fabricated reinforcement cage 10 from deformation when it is hoisted through a hanger rope from a hoist. In contrast, area B occupies a small part of the pre-fabricated reinforcement cage 10 in the height direction, and in area B, the plurality of stirrups 16 are loosely tied to the outer circumferences of the plurality of rebars 14 so that they may be easily moved to different positions when it becomes necessary. In addition, first end portions 17 (i.e., a lower end portion) of each of the plurality of rebars 14 are not surrounded by the stirrups 16 to enhance the stiffness of the pre-fabricated reinforcement cage 10. Consequently, the portion of the plurality of rebars 14 from area B to the first end portions 17 at a lower part of the rebars 14 has less rigidity (or greater flexibility) than the rebars 14 located in area A, so that an operator may easily and manually move and tune the positions of the first end portions 17 of the rebars 14.

Figure 2:
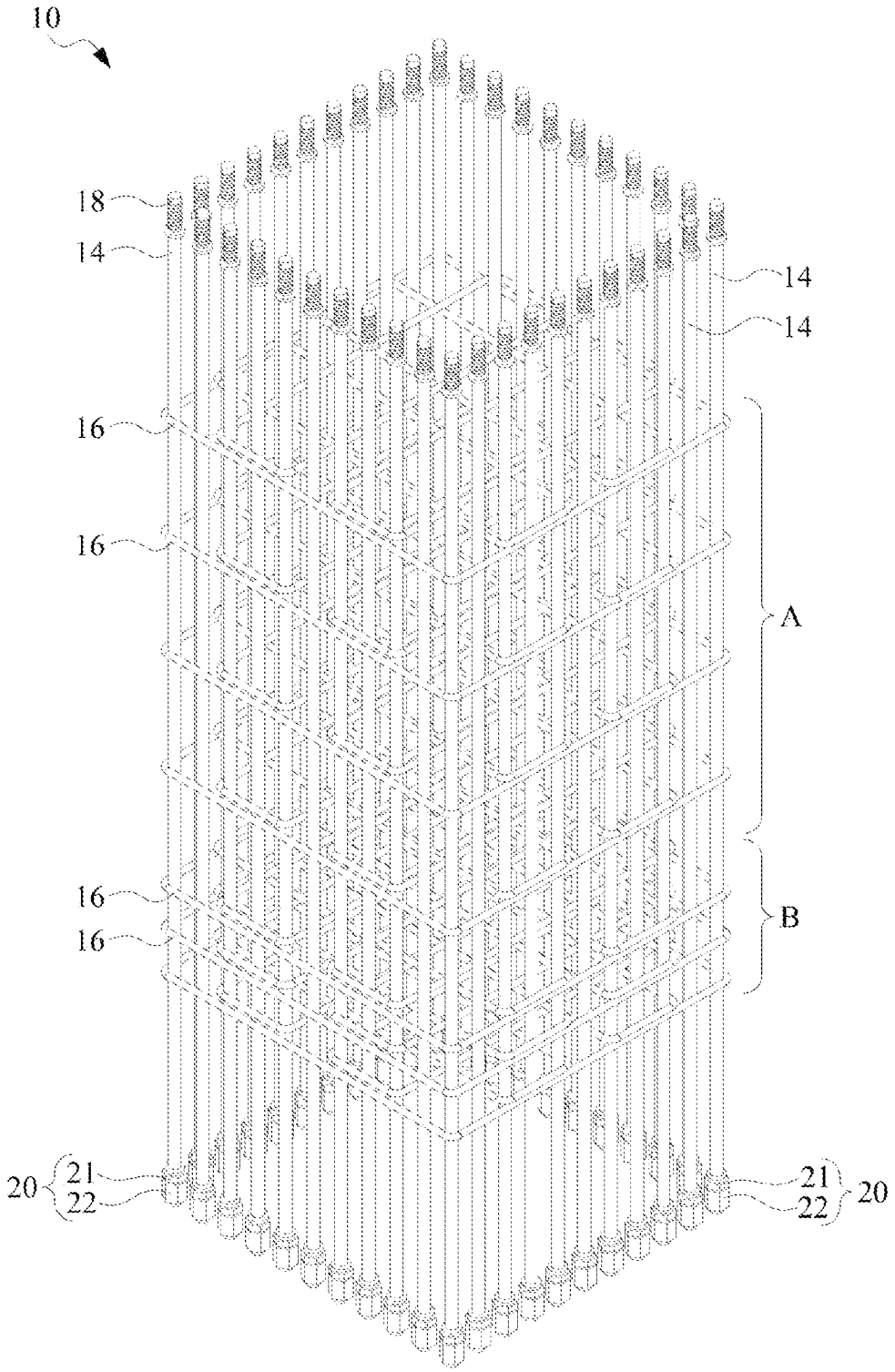
FIG. 2 is a schematic view of a pre-fabricated reinforcement cage on which couplers are threadedly engaged.

As shown in FIGS. 1 and 2, the first end portion 17 (i.e., the lower end portion) of each of the plurality of rebars 14 has a first threaded section S1, and a coupler 20 may be threadedly engaged with each first threaded section S1. FIG. 2 is a schematic view showing a pre-fabricated reinforcement cage on which couplers are threadedly engaged. Each coupler 20 may include a nut 21 and a threaded sleeve 22. The nut 21 is first threadedly engaged with a first threaded section S1 of a first end portion 17 of a corresponding rebar 14, and then the threaded sleeve 22 is threadedly engaged with the first threaded section S1 of the first end portion 17 of the corresponding rebar 14.

Figure 3:
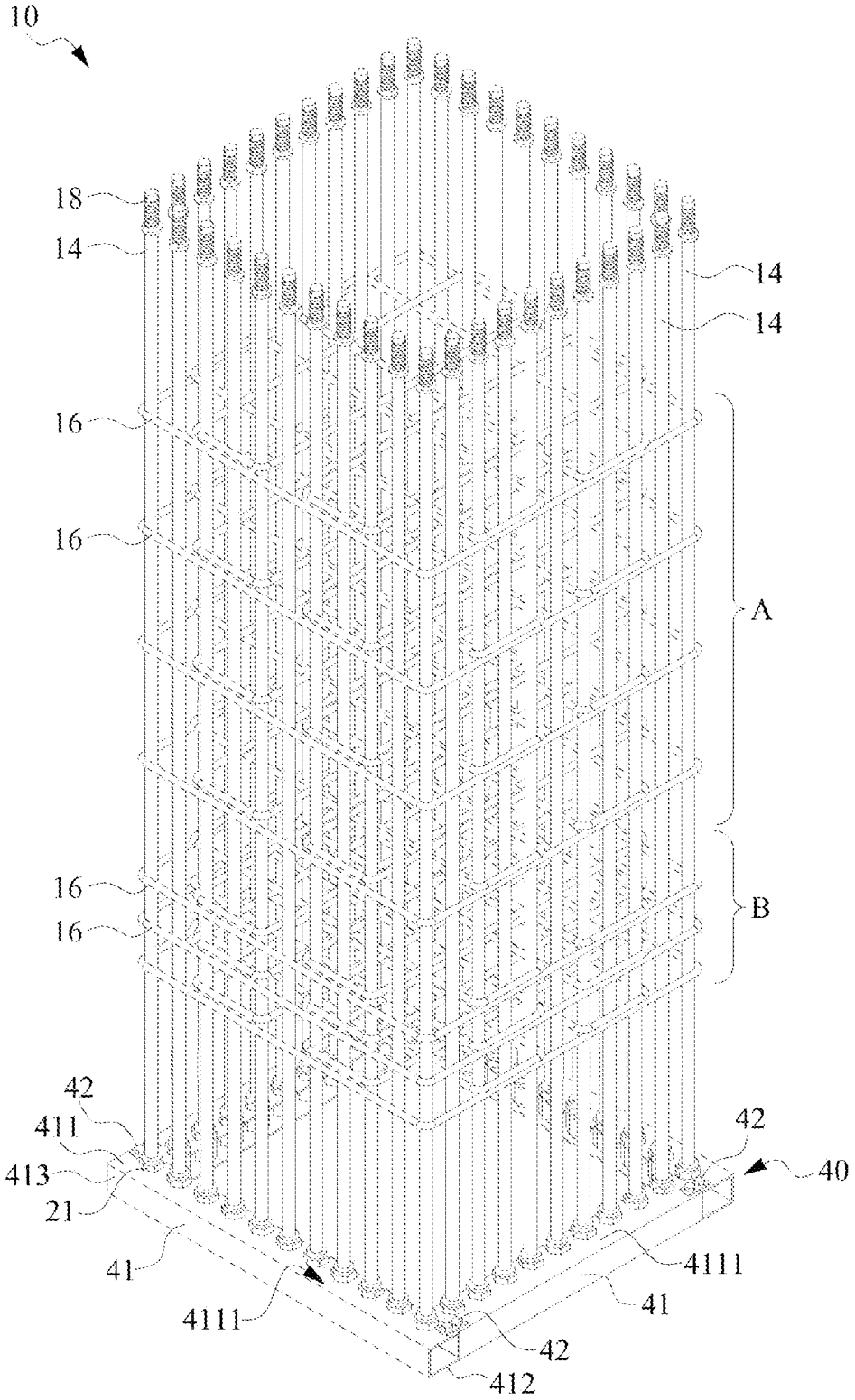
FIG. 3 is a schematic view of a pre-fabricated reinforcement cage structure in which the pre-fabricated reinforcement cage is assembled with a first rebar-mounting frame.
Figure 4:
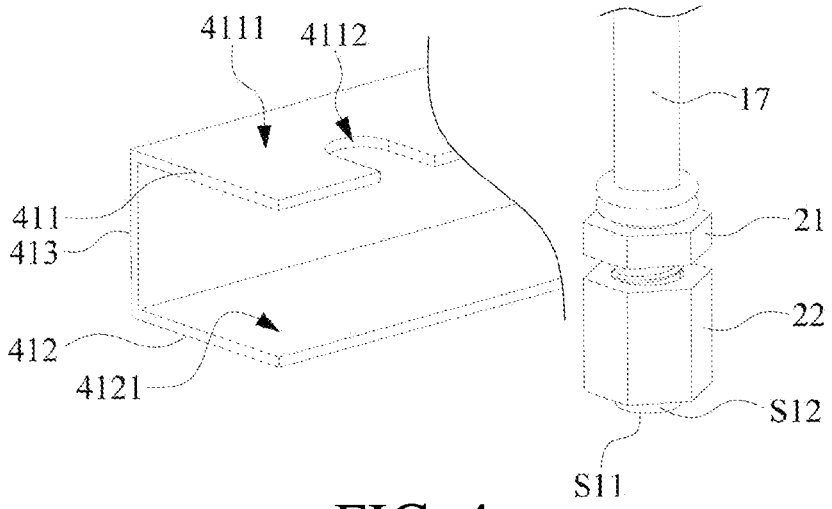
FIG. 4 is a regional schematic structural view showing a rebar of the pre-fabricated reinforcement cage before being engaged with and secured to a first rebar-mounting frame.

FIG. 3 is a schematic view showing a pre-fabricated reinforcement cage structure in which the pre-fabricated reinforcement cage 10 and a first rebar-mounting frame 40 are assembled. FIG. 4 is a schematic view showing that the first end portion 17 of the rebar 14 of the pre-fabricated reinforcement cage 10 is to be engaged with and secured to a first rebar-mounting frame 40. As shown in FIG. 3, the first rebar-mounting frame 40 comprises a plurality of mounting frames 41 connected to each other through a plurality of mounting members 42, and is configured to surround the first end portions 17 of the plurality of rebars 14, and form a closed shape (for example, a hollow rectangle shape is formed in this embodiment).

As shown in FIG. 4, each of the plurality of mounting frames 41 of the first rebar-mounting frame 40 comprises a first top plate 411, a first bottom plate 412, and a first lateral plate 413, which form a structure resembling a Chinese character "⊏" (which includes, but is not limited to, a steel channel structure). In addition, after the plurality of mounting frames 41 are assembled to form the first rebar-mounting frame 40, the upper surfaces 4111 of the first top plates 411 of the mounting frames 41 are aligned and flush with each other, and the upper surfaces 4121 of the first bottom plates 412 of the mounting frames 41 are also aligned and flush with each other. In this way, vertical heights between the upper surfaces 4111 of the first top plates 411 and the upper surfaces 4121 of the first bottom plates 412 of the plurality of mounting frames 41 are the same.

Figure 5A:
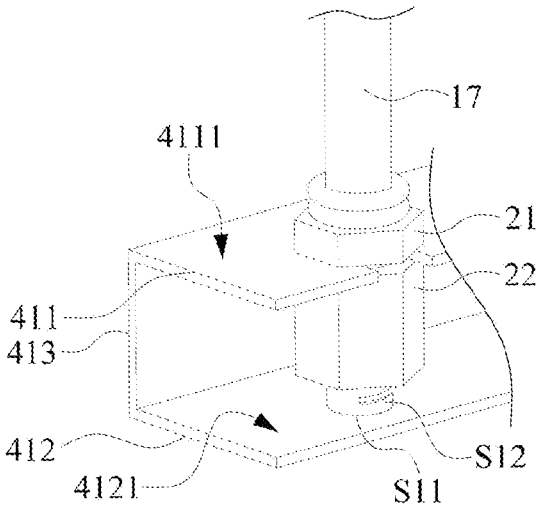
FIG. 5A and FIG. 5B are regional schematic structural views in which a notch of the first rebar-mounting frame receives and is engaged with a first end portion of a rebar.
Figure 5B:
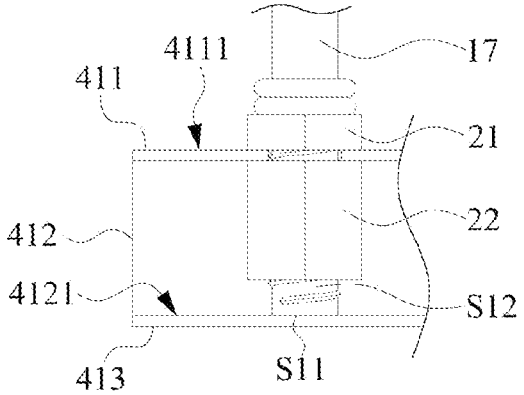

As shown in FIG. 4, a plurality of notches 4112 are formed on the first top plates 411 of the mounting frames 41 of the first rebar-mounting frame 40 and are evenly pitched along a length direction of the first top plates 411. The notches 4112 are located on a side opposite to the side of the first lateral plate 413. FIG. 5A and FIG. 5B show that each of the plurality of notches 4112 is configured to receive the first end portion 17 of each of the plurality of rebars 14. Referring to FIG. 4, a gap exists between the nut 21 and the threaded sleeve 22 threadedly engaged with the first threaded section S1 of the first end portion 17 of the rebar 14, so that, through the gap, the first end portion 17 of the rebar 14 may be entered into and received in the notch 4112 of the mounting frame 41 of the corresponding first rebar-mounting frame 40. In this case, as shown in FIG. 5A and FIG. 5B, a first end surface S11 at a bottom of the first threaded section S1 of the first end portion 17 of each of the rebars 14 is caused to abut against the upper surface 4121 of the first bottom plate 412 of the mounting frame 41 through adjustment of the nut 21 and/or the threaded sleeve 22. In addition, an operator may respectively screw up and/or down the nut 21 and the threaded sleeve 22 located on the first threaded section S1 to adjust the positions of the nut 21 and the threaded sleeve 22, so that the nut 21 and the threaded sleeve 22 are collaborative. Therefore, a lower surface of the nut 21 abuts against the upper surface 4111 of the first top plate 411 of the mounting frame 41 of the first rebar-mounting frame 40 at the notch 4112 receiving the rebar 14, and an upper surface of the threaded sleeve 22 abuts against a lower surface of the first top plate 411 of the mounting frame 41 of the first rebar-mounting frame 40 at the notch 4112 receiving the rebar 14. Thus, the first top plate 411 of the mounting frame 41 of the first rebar-mounting frame 40 is sandwiched between the nut 21 and the threaded sleeve 22, so that the rebar 14 is received in the notch 4112 and is secured to the mounting frame 41. As shown in FIG. 5A and FIG. 5B, a length of the threaded sleeve 22 is preferably designed so that a part of the first threaded section S1 of the first end portion 17 of the rebar 14 is exposed and not covered by the threaded sleeve 22 when the nut 21 and the threaded sleeve 22 snugly hold the first top plate 411 of the mounting frame 41, and the first end surface S11 of the first threaded section S1 of the rebar 14 abuts against the upper surface 4121 of the first bottom plate 412. The exposed part S12 includes the first end surface S11.

When the first end portions 17 of all of the rebars 14 are received in the corresponding notches 4112 of the plurality of mounting frames 41 and are engaged with and secured to the mounting frames 41 through the couplers 20, the pre-fabricated reinforcement cage structure shown in FIG. 3 is formed in which the pre-fabricated reinforcement cage 10 and the first rebar-mounting frame 40 are assembled. Since the upper surfaces 4111 of the first top plates 411 and the upper surfaces 4121 of the first bottom plates 412 of the plurality of mounting frames 41 of the first rebar-mounting frame 40 are aligned, and the first end surfaces S11 of the first threaded sections S1 of the first end portions 17 of the rebars 14 abut against the upper surfaces 4121 of the first bottom plates 412 of the mounting frames 41, the first end surfaces S11 of the first threaded sections S1 of the rebars 14 of the pre-fabricated reinforcement cage 10 are aligned with each other in the height direction, and are levelled.

Figure 6A:
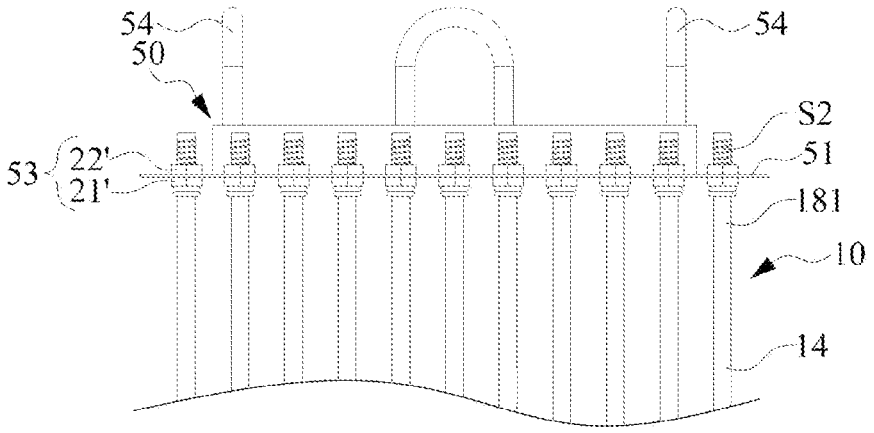
FIG. 6A is a regional schematic structural view in which the pre-fabricated reinforcement cage is detachably assembled with a second rebar-mounting frame.
Figure 6B:
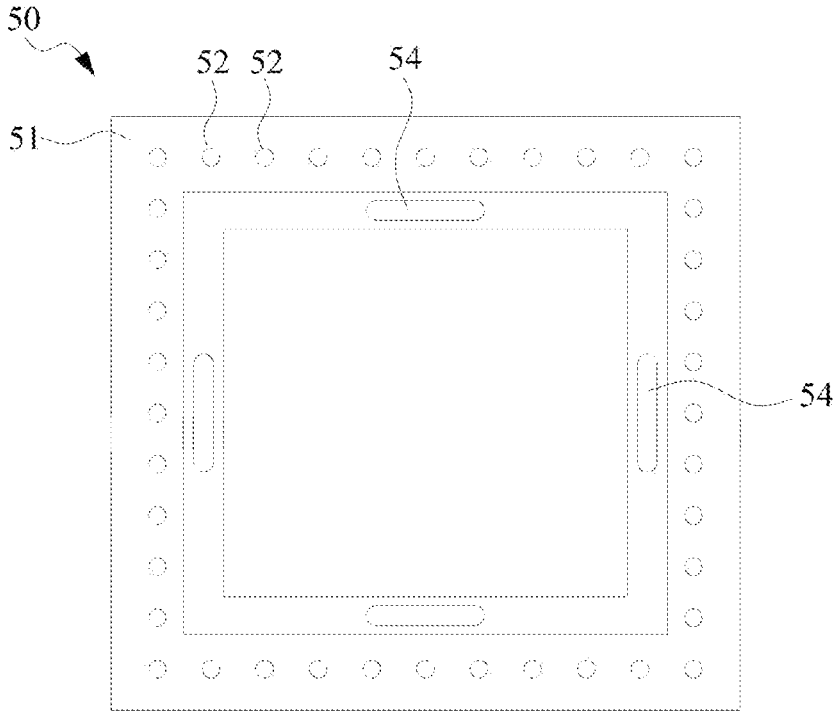
FIG. 6B is a schematic top view of a second rebar-mounting frame.

According to an embodiment of this application, FIG. 6A shows that second end portions 18 of the plurality of rebars 14 of the pre-fabricated reinforcement cage 10 opposite to the first end portions 17 are detachably assembled with a second rebar-mounting frame 50. FIG. 6B is a schematic top view of the second rebar-mounting frame 50. As shown in FIG. 6A, the second end portions 18 of each of the rebars 14 of the pre-fabricated reinforcement cage 10 have a second threaded section S2. As shown in FIG. 6B, the second rebar-mounting frame 50 includes a closed-frame 51, and a plurality of through holes 52 are arranged in a periphery of the closed-frame 51. As shown in FIG. 6A, the second rebar-mounting frame 50 further includes a plurality of connectors 53 arranged at the positions corresponding to the plurality of through holes 52. Each of the plurality of connectors 53 is configured to be detachably fix a corresponding second end portion 18 of each of the plurality of rebars 14 to the second rebar-mounting frame 50. As shown in FIG. 6A, the connector 53 includes a nut 21' and another nut 22' threadedly engaged with the second threaded section S2 of the second end portion 18 of the rebar 14. In FIG. 6A, an operator first threadedly engages the nut 21' with a position of the second threaded section S2 of each of the plurality of rebars 14 at a predetermined height. When the nut 21' is sleeved at each of the positions of the second threaded sections S2 of all of the rebars 14 at the same height, the plurality of through holes 52 formed along a circumferential direction of the closed-frame 51 of the second rebar-mounting frame 50 are respectively aligned with the corresponding plurality of rebars 14, and then the second threaded sections S2 of the second end portions 18 of the plurality of rebars 14 are respectively inserted to the corresponding plurality of through holes 52, so that the second rebar-mounting frame 50 is placed on upper surfaces of the plurality of nuts 21'. Then, each of the plurality of nuts 22' is threadedly sleeved on the second threaded section S2 of the second end portion 18 of the corresponding rebar 14. Since the lower surface of each nut 22' abuts against an upper surface of the closed-frame 51 of the second rebar-mounting frame 50, the second rebar-mounting frame 50 is firmly secured to the second end portion 18 of each of the plurality of rebars 14 wherein the second end portion 18 is opposite to the first end portion 17. It should be noted that, an operator may maintain the closed-frame 51 of the second rebar-mounting frame 50 to be horizontal through the adjustment of the positions of the nuts 21' and the nuts 22' on the second threaded sections S2 of the rebars 14.

Figure 7:
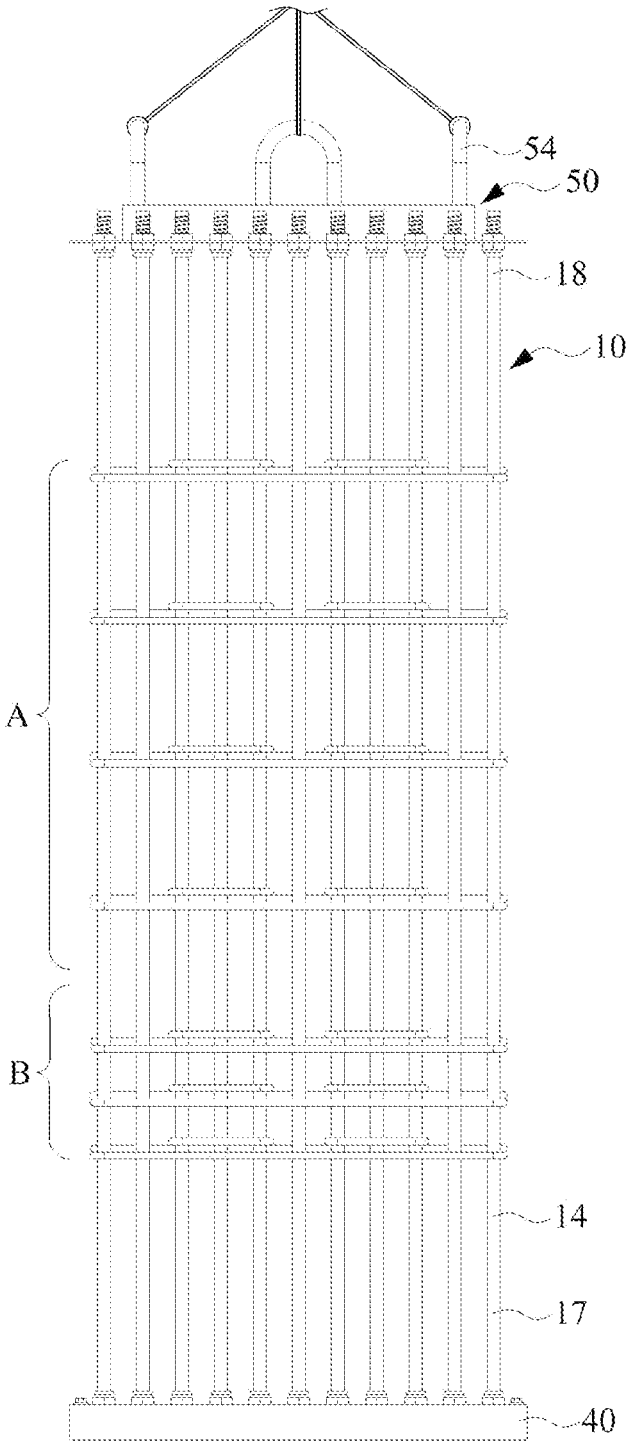
FIG. 7 is a schematic vertical view of the pre-fabricated reinforcement cage structure in a hoisted state.

As shown in FIG. 6B, the second rebar-mounting frame 50 further includes at least one hook or hoist-ring 54 mounted on the upper surface of the closed-frame 51, which serves as a hoisting support for a hanger rope of a hoist to strap the pre-fabricated reinforcement cage 10. When the first end portions 17 of the rebars 14 of the pre-fabricated reinforcement cage 10 are secured to the first rebar-mounting frame 40 and the second end portions 18 are secured to the second rebar-mounting frame 50, an assembly shown in FIG. 7 that is ready for being hoisted is formed. In this case, the hanger rope of the hoist may pass through the hook or hoist-ring 54 on the second rebar-mounting frame 50. Through the hanger rope of the hoist, the pre-fabricated reinforcement cage structure may be hoisted to a position above to-be-connected rebars (for example, exposed tops of rebars of a lower RC column), to facilitate subsequent connection of each rebar 14 of the pre-fabricated reinforcement cage 10 to a corresponding to-be-connected rebar.

Figure 8A:
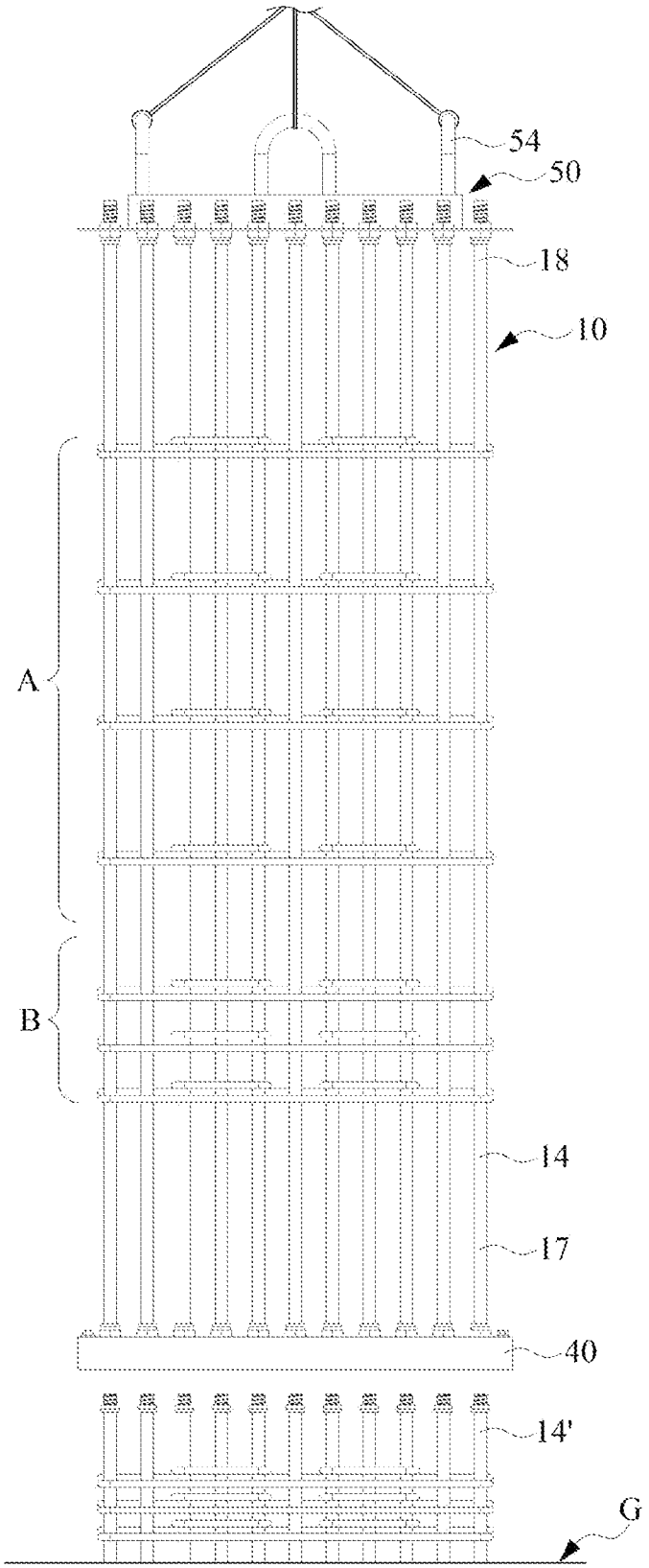
FIG. 8A is a schematic view of the pre-fabricated reinforcement cage structure hoisted at a predetermined height above corresponding to-be-connected rebars.
Figure 8B:
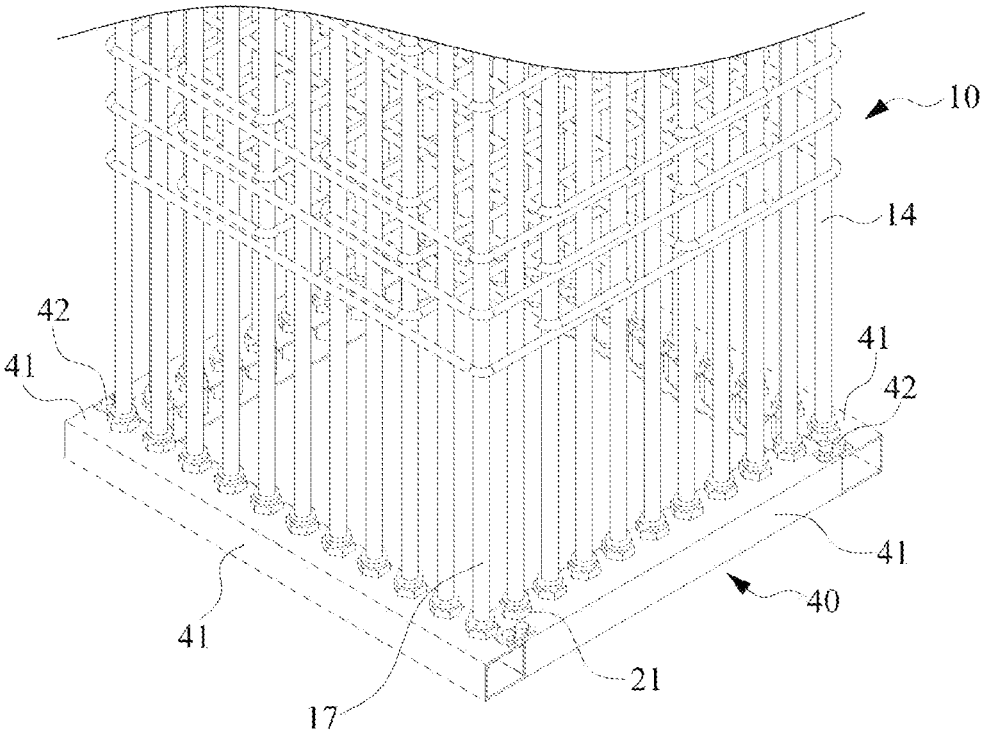
FIG. 8B is a regional schematic structural view of the pre-fabricated reinforcement cage structure in FIG. 8A.

FIG. 8A is a schematic view showing the step of hoisting the pre-fabricated reinforcement cage structure to a position above corresponding to-be-connected rebars 14'. As shown in FIG. 8A, the pre-fabricated reinforcement cage 10 assembled with the first rebar-mounting frame 40 and the second rebar-mounting frame 50 is hoisted to, for example, a position at an appropriate height that is directly above corresponding to-be-connected rebars 14' extending from the inside of a floor surface G of a building (not shown in the figure). FIG. 8B is a regional schematic structural view of the pre-fabricated reinforcement cage structure in FIG. 8A. As shown in FIG. 8B, the first end portion 17 of each rebar 14 of the pre-fabricated reinforcement cage 10 is secured to a corresponding mounting frame 41 that forms the first rebar-mounting frame 40.

Figure 9A:
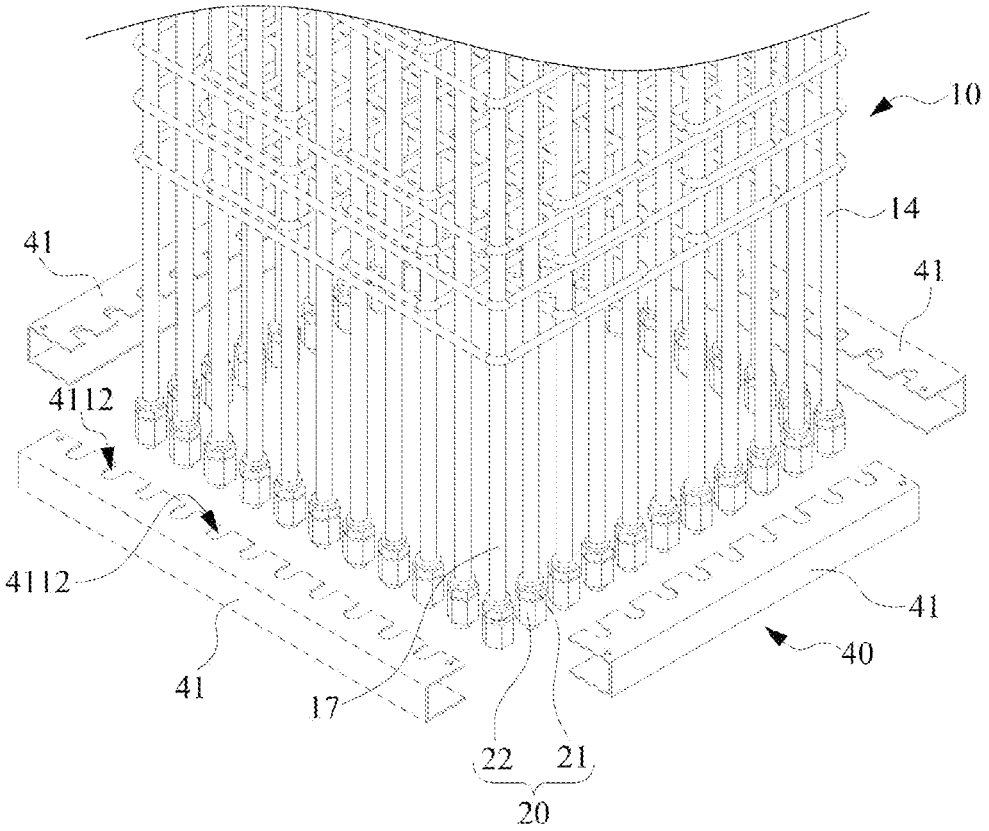
FIG. 9A is a regional schematic structural view in which the first rebar-mounting frame is detached from the pre-fabricated reinforcement cage structure.
Figure 9B:
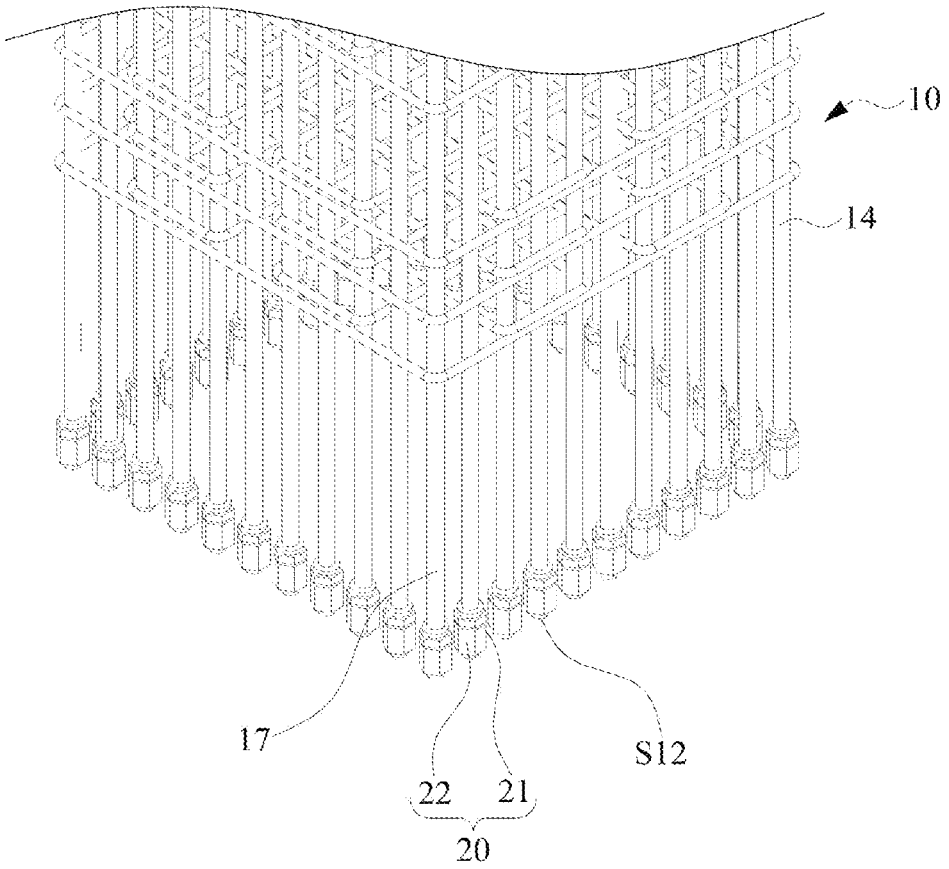
FIG. 9B is a regional schematic structural view of the pre-fabricated reinforcement cage structure after the first rebar-mounting frame is removed.

FIG. 9A is a regional schematic structural view in which the first rebar-mounting frame 40 is detached from the pre-fabricated reinforcement cage 10. As shown in FIG. 9A, when the pre-fabricated reinforcement cage 10 is hoisted to an appropriate height above a floor having the corresponding to-be-connected rebars 14', the operator loosens one by one the couplers 20 so that the couplers no longer secure the rebars 14 of the pre-fabricated reinforcement cage 10 to the first rebar-mounting frame 40. Thereafter, the operator separates the pre-fabricated reinforcement cage 10 from the first rebar-mounting frame 40. In detail, the operator removes the mounting members 42 (see FIG. 8B) so that the mounting frames 41 are no longer fixedly connected to each other. Then, the operator may rotate upward and downward the nut 21 and the threaded sleeve 22 of the coupler 20 respectively on the first threaded section S1 of the first end portion 17 of the rebar 14, to loosen the nut 21 and the threaded sleeve 22, so that the nut 21 and the threaded sleeve 22 no longer snugly hold the first top plate 411 of the mounting frame 41 of the first rebar-mounting frame 40. After the nuts 21 and the threaded sleeves 22 of all of the couplers 20 are loosened, the mounting frames 41 are detached from the corresponding plurality of rebars 14 (e.g., the rebars 14 are detached from the corresponding notches 4112 of the mounting frames 41). As shown in FIG. 9B, the mounting frames 41 are detached from the pre-fabricated reinforcement cage 10 and the first rebar-mounting frame 40 is removed from the pre-fabricated reinforcement cage 10. In this case, the nut 21 and the threaded sleeve 22 of the coupler 20 still remain on the first threaded section S1 of the rebar 14 of the pre-fabricated reinforcement cage 10, and a part S12 of the first threaded section S1 is exposed and not covered by the threaded sleeve 22. It should be noted that, when the first rebar-mounting frame 40 is assembled and secured to the pre-fabricated reinforcement cage 10, since the first end surfaces S11 of the first threaded sections S1 of the rebars 14 of the pre-fabricated reinforcement cage 10 are aligned with each other in the height direction and are located on the same horizontal plane, after the first rebar-mounting frame 40 is removed from the pre-fabricated reinforcement cage 10, the first end surfaces S11 of the first threaded sections S1 of the rebars 14 are still at the same horizontal plane height.

Figure 10A:
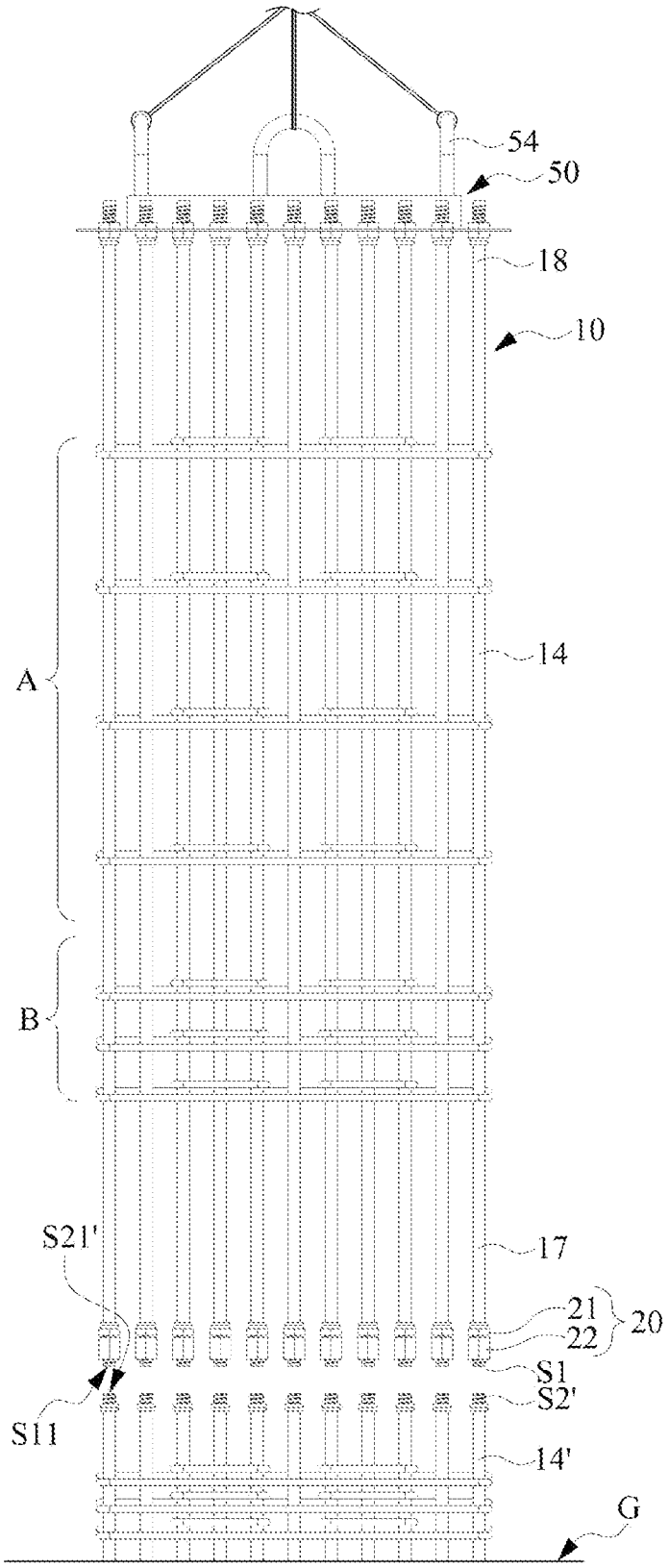
FIG. 10A is a schematic view showing the step of hoisting the pre-fabricated reinforcement cage with the first rebar-mounting frame being removed to a position above to-be-connected rebars.
Figure 10B:
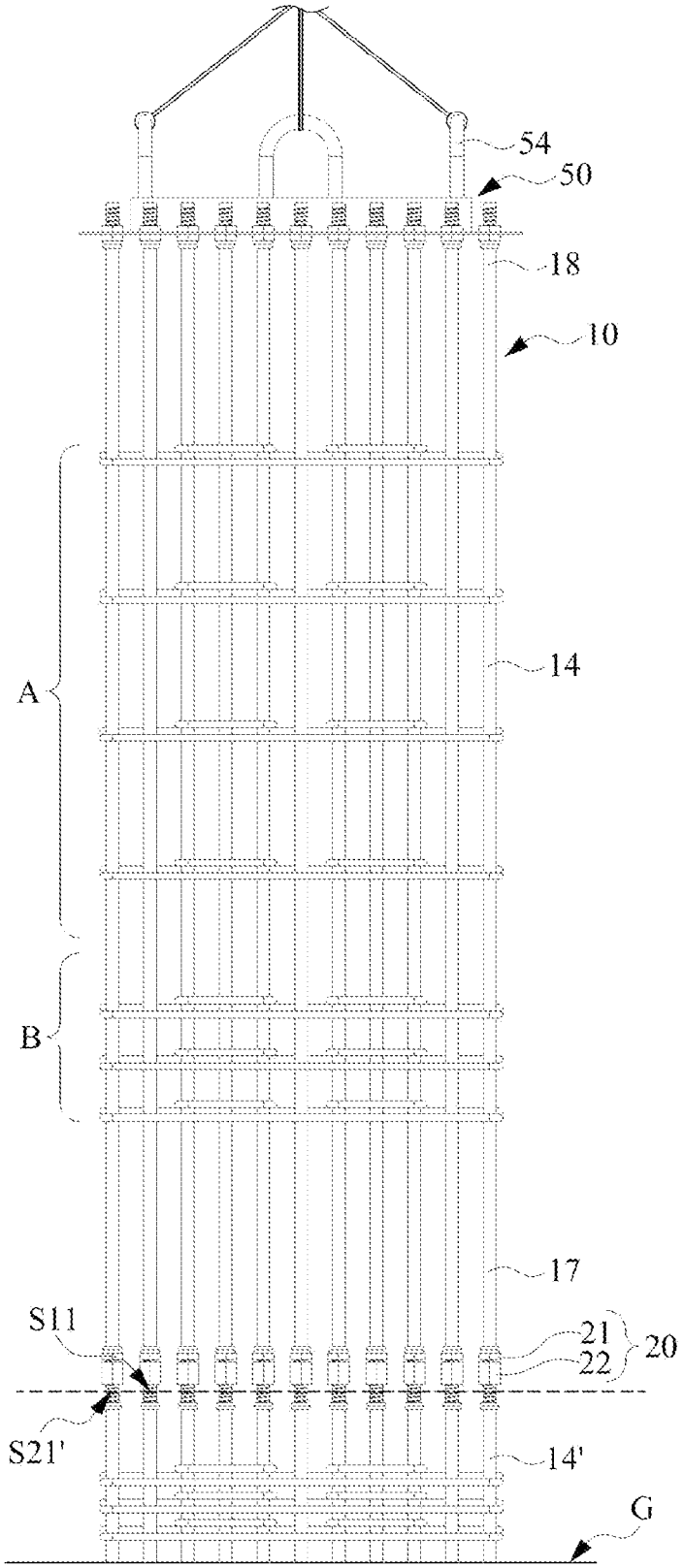
FIG. 10B is a schematic view showing the step of hoisting the pre-fabricated reinforcement cage with the first rebar-mounting frame being removed to allow contact with upper ends of the to-be-connected rebars.

FIG. 10A is a schematic view showing the step of hoisting the pre-fabricated reinforcement cage to a height above the corresponding plurality of to-be-connected rebars 14' configured for contacting the rebars 14 of the pre-fabricated reinforcement cage 10. FIG. 10B is a schematic view showing the step of hoisting the pre-fabricated reinforcement cage 10 so that the plurality of rebars 14 of the pre-fabricated reinforcement cage 10 contact the upper portions of the corresponding plurality of to-be-connected rebars 14'. As shown in FIG. 10A and FIG. 10B, after the first rebar-mounting frame 40 is removed from the pre-fabricated reinforcement cage 10, the operator adjusts the position of the pre-fabricated reinforcement cage 10, so that the plurality of rebars 14 of the pre-fabricated reinforcement cage 10 are respectively aligned with the corresponding plurality of to-be-connected rebars 14'. Then, through the hanger rope, the hoist hoists the pre-fabricated reinforcement cage 10 downward to cause the plurality of rebars 14 to be aligned with and contact the tops of the corresponding plurality of to-be-connected rebars 14' respectively at a predetermined height (for example, a contact plane in FIG. 10B represented by a dashed line). In this case, the first end surface S11 of the first threaded section S1 of each of the plurality of rebars 14 contacts a second end surface S21' of a second threaded section S2' of each of the corresponding plurality of to-be-connected rebars 14'.

Figure 11A:
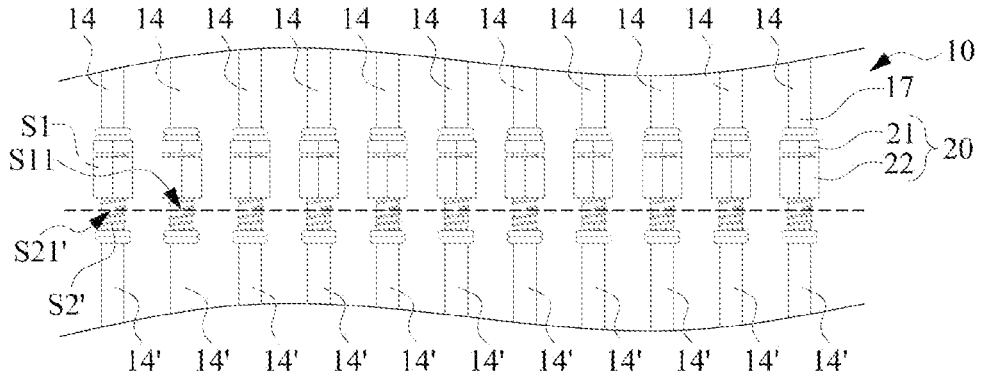
FIG. 11A to FIG. 11C are schematic views showing the step of connecting rebars of the pre-fabricated reinforcement cage to to-be-connected rebars through couplers.
Figure 11B:
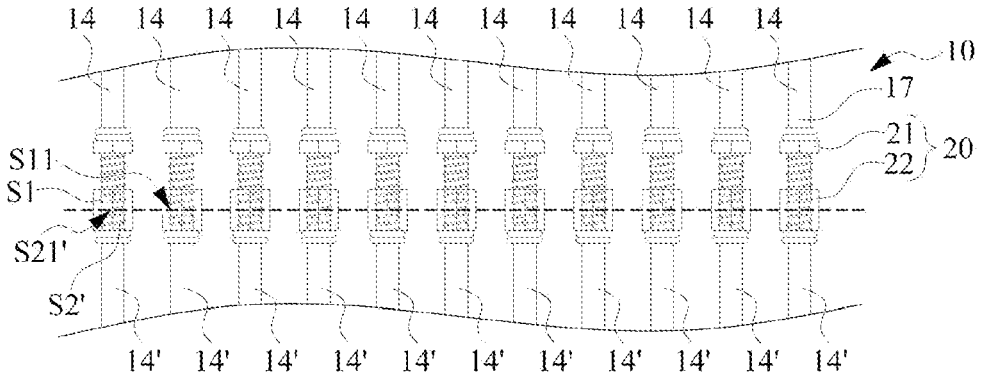
Figure 11C:
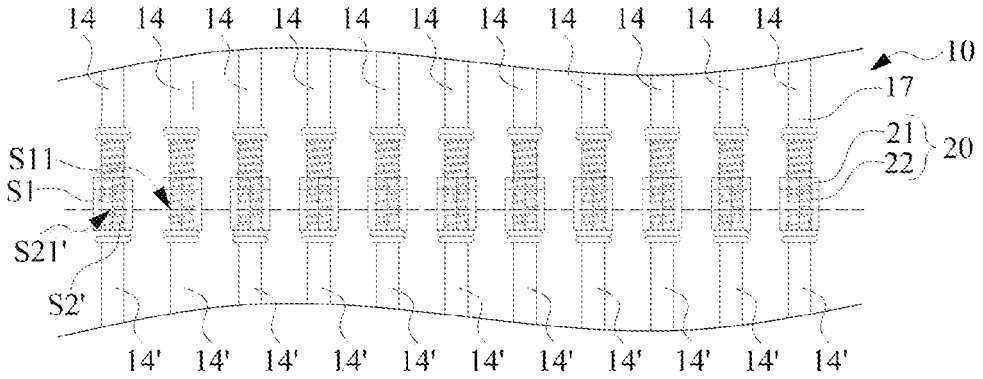
Figure 12A:
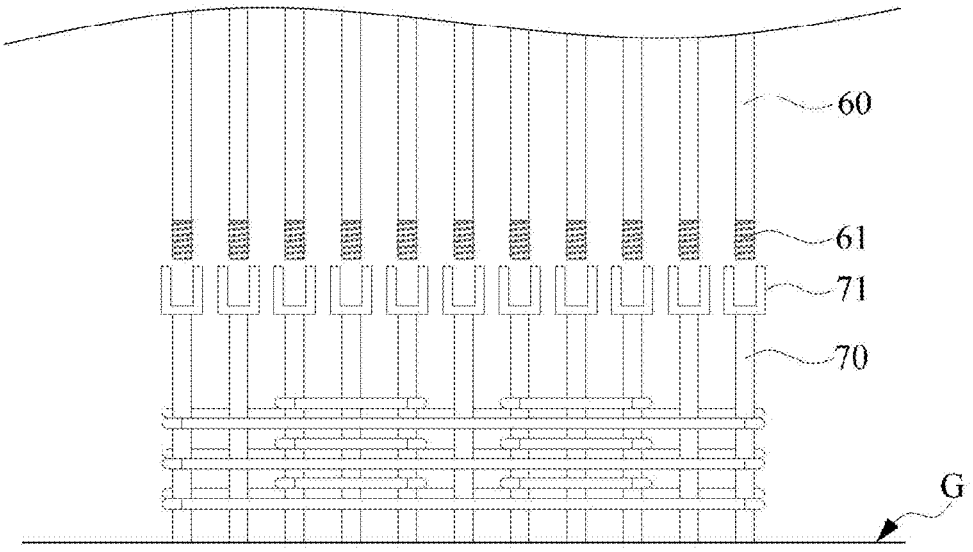
FIG. 12A (Prior Art)
FIG. 12A and FIG. 12B are schematic views showing a conventional method of connecting column steel bars with couplers.
Figure 12B:
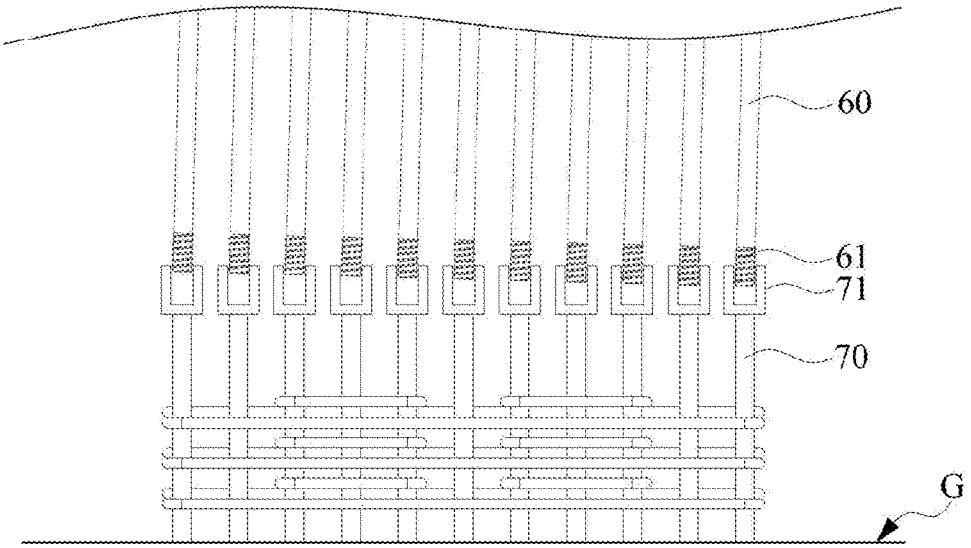
FIG. 12B (Prior Art)

FIG. 11A to FIG. 11C are schematic views showing the steps of connecting the rebar 14 of the pre-fabricated reinforcement cage 10 to the to-be-connected rebar 14' through the coupler 20. It should be noted that, FIG. 11A to FIG. 11C are regional structural enlarged views. As shown in FIG. 11A, the first end surface S11 of the first threaded section S1 of each of the plurality of rebars 14 of the pre-fabricated reinforcement cage 10 contacts the second end surface S21' of the second threaded section S2' of each of the corresponding plurality of to-be-connected rebars 14' at a predetermined height (for example, a contact plane in FIG. 11A represented by a dashed line). In this case, the nut 21 and the threaded sleeve 22 of the coupler 20 are both located on the first threaded section S1 of the rebar 14. Then, as shown in FIG. 11B, the operator rotates downward only the threaded sleeve 22 originally located on the first threaded section S1 of the rebar 14, to simultaneously enclose the second threaded section S2' of the corresponding to-be-connected rebar 14' and the first threaded section S1 of the rebar 14. A length of the threaded sleeve 22 is designed preferably to enclose the entire second threaded section S2' of the to-be-connected rebar 14' and a part of the first threaded section S1 of the rebar 14, or enclose a part of the second threaded section S2' of the to-be-connected rebar 14' and a part of the first threaded section S1 of the rebar 14. It should be noted that the second threaded section S2' and the part of the first threaded section S1 of the rebar 14 enclosed by the threaded sleeve 22 (that is, a length of the second threaded section S2' and a length of the first threaded section S1 enclosed by the threaded sleeve 22) satisfy a required structural strength of a joint of rebars. Then, as shown in FIG. 11C, the operator rotates downward the nut 21 located on the first threaded section S1 of the rebar 14, and causes the nut 21 to contact the threaded sleeve 22 on the first threaded section S1 and abut against the threaded sleeve 22 to a predetermined torque strength, thus completing the operation of connection between the rebar 14 and the corresponding to-be-connected rebar 14'. After the operator connects the rebars 14 of the pre-fabricated reinforcement cage 10 to the corresponding to-be-connected rebars 14' one by one in the above manner, the hoisting and assembly operations of the pre-fabricated reinforcement cage 10 are completed, and the hanger rope may be removed from the hook or the hoist-ring 54 of the second rebar-mounting frame 50. Next, the operator further removes the second rebar-mounting frame 50 from the pre-fabricated reinforcement cage 10, or the second rebar-mounting frame 50 may be still secured to the pre-fabricated reinforcement cage 10, to further fix the position of the second end portion 18 of each of the rebars 14 of the pre-fabricated reinforcement cage 10, for use in subsequent hoisting and engagement operations of another pre-fabricated reinforcement cage.

It should be noted that, unlike a regular rebar obtained through cutting of a steel bar with low cutting precision, which may have a deviation up to several centimeters, the rebar 14 used for the pre-fabricated reinforcement cage 10 in this disclosure is preferably obtained through a precise cutting process of steel bars. Therefore, the plurality of rebars 14 have extremely small deviations. During the hoisting of the pre-fabricated reinforcement cage 10 for causing the end surface of each of the rebars 14 to contact the end surface of each of the corresponding to-be-connected rebars 14', the first end surface S11 of some rebars 14 may not precisely contact the second end surface S21' of the corresponding to-be-connected rebar 14' for certain reasons. Despite this, since the rebars 14 of the pre-fabricated reinforcement cage 10 in this disclosure have extremely small deviations, the threaded sleeves 22 can still be engaged well with the threads of the first threaded sections S1 and the second threaded sections S2' while connecting the rebars 14 and the to-be-connected rebars 14'. With such structure, it can be ensured that the connecting positions of the rebars have a required strength when the threaded sleeves 22 have enclosed the rebars 14 and the to-be-connected rebars 14' and the nuts 21 have abutted against the threaded sleeves 22 to a predetermined torque strength.

The pre-fabricated reinforcement cage structure and the method for hoisting and assembling the same disclosed in this disclosure have at least the following beneficial technical effects: (a) since each rebar 14 of the pre-fabricated reinforcement cage 10 is secured to the first rebar-mounting frame 40 through the first end portion 17 thereof, during adjustment of the upper surfaces 4121 of the first bottom plates 412 of the plurality of mounting frames 41 of the first rebar-mounting frame 40 or the upper surface 4111 of the first top plates 411 of the plurality of mounting frames 41 to align the upper surfaces with each other in height, the end surfaces S11 of the first end portions 17 of the rebars 14 of the pre-fabricated reinforcement cage 10 are also aligned with each other in the height direction (that is, located in the same horizontal plane or height), so that the rebar connection is precise and improved, and the connection of the rebars 14 of the pre-fabricated reinforcement cage 10 to the to-be-connected rebars 14' is expedited; and (b) through the structure including the pre-fabricated reinforcement cage 10 and the first rebar-mounting frame 40 disclosed in this application, a precision of connection between each of the rebars 14 and each of the to-be-connected rebars 14' can be obtained in both the horizontal direction and the vertical direction during the connecting process. In addition, a desirable connection quality is thus realized between the rebars 14 of the pre-fabricated reinforcement cage 10 and the to-be-connected rebars 14'. Moreover, the pre-fabricated reinforcement cages 10 provide a consistent connection precision during construction of a building, which increases the structural quality of the building thus made.

The pre-fabricated reinforcement cage structure and the method for hoisting and assembling the same disclosed in this disclosure are applicable to, but not limited to, for example, a reinforcement cage connection for columns in a building, a reinforcement cage connection for a foundation pile, and a central structural column connection for a high technology factory.

The terminology used in the description of the present disclosure is for the purpose of describing particular embodiments only, and is not intended to limit the disclosure. As used in the description of the disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items.

It shall be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The use of directional adjectives "above, "under," "upper," "lower," "below," "left," "right," "up," "down," "top," "bottom," "vertical," "horizontal," and like terms, are meant to assist with understanding relative relationships among design elements and should not be construed as meaning an absolute direction in space nor regarded as limiting. For example, in some embodiments, "a first component is on a second component" describes the first component being on the second component (the first component is directly on the second component), while some other components are between the first and second components.

Terms such as "approximately," "substantially," or "about" are applied to describe a small variation of a structural unit of an apparatus. When a term is used in conjunction with another term to describe a particular characteristic of the claimed disclosure, such term can indicate the exact events or circumstances, and similar exact events or circumstances.

Obviously, numerous modifications and variations of the present disclosure are possible in light of the above teachings. It is therefore to be understood that within the scope of the appended claims, the present disclosure may be practiced otherwise than as specifically described herein.

What is claimed is:

1. A pre-fabricated reinforcement cage structure, comprising:

a pre-fabricated reinforcement cage including:

a plurality of rebars; and a plurality of stirrups binding to outer circumferences of and fixed to the plurality of rebars, the plurality of stirrups being spaced apart along a length direction of the plurality of rebars so that the plurality of rebars are substantially parallel to each other;

a plurality of couplers each threadedly engaging with a first end portion of each of the plurality of rebars; and a first rebar-mounting frame configured to be engaged with the plurality of couplers so that the first end of each of the plurality of rebars is held by the first rebar-mounting frame, wherein the first rebar-mounting frame comprises:

a first top plate having a plurality of notches formed along an edge of the first top plate, each of the plurality of notches configured to receive the first end portion of a corresponding one of the plurality of rebars;

a first bottom plate, wherein the first end portion of each of the plurality of rebars abuts against a first top surface of the first bottom plate; and a first lateral plate to which each of the first top plate and the first bottom plate is connected.

2. The pre-fabricated reinforcement cage structure according to claim 1, wherein the first end portion of each of the plurality of rebars comprises a first threaded section, and wherein each of the plurality of couplers comprises a nut and a threaded sleeve threadedly and sequentially coupling to the first threaded section; and wherein the nut and the threaded sleeve of each of the plurality of couplers respectively abut against a first top surface and a bottom surface of the first top plate, thereby sandwiching the first top plate of the first rebar-mounting frame between the nut and the threaded sleeve.

3. The pre-fabricated reinforcement cage structure according to claim 2, further comprising a second rebar-mounting frame configured to be detachably fixed to a second end portion of each of the plurality of rebars, the second end portion being opposite to the first end portion of the plurality of rebars.

4. The pre-fabricated reinforcement cage structure according to claim 3, wherein a portion of the first threaded section of the first end portion of each of the plurality of rebars comprises a first end surface that is exposed and not covered by the threaded sleeve of the coupler.

5. The pre-fabricated reinforcement cage structure according to claim 2, wherein the first rebar mounting frame is formed from a plurality of mounting frames assembled with each other, and has a closed-shape surrounding the first end portions of the plurality of rebars; and wherein top surfaces of bottom plates of corresponding mounting frames are aligned, and wherein top surfaces of top plates of corresponding mounting frames are aligned.

6. The pre-fabricated reinforcement cage structure according to claim 1, further comprising a second rebar-mounting frame configured to be detachably fixed to a second end portion of each of the plurality of rebars, the second end portion being opposite to the first end portion of the plurality of rebars.

7. The pre-fabricated reinforcement cage structure according to claim 6, wherein a portion of the first threaded section of the first end portion of each of the plurality of rebars comprises a first end surface that is exposed and not covered by the threaded sleeve of a respective coupler of the plurality of couplers.

8. The pre-fabricated reinforcement cage structure according to claim 6, wherein the second rebar-mounting frame comprises:

a closed-frame comprising a plurality of through-holes formed thereon and having a hole in a center of closed-frame;

a plurality of connectors respectively engaged in the plurality of the through-holes, each of the plurality of connectors configured to be fixedly mounted to a corresponding second end portion that is opposite to the first end portion of each of the plurality of rebars; and at least one hook or hoist-ring mounted on an upper surface of the closed-frame.

9. The pre-fabricated reinforcement cage structure according to claim 1, wherein the first rebar mounting frame is formed from a plurality of mounting frames assembled with each other, and has a closed-shape surrounding first end portions of the plurality of rebars; and wherein top surfaces of bottom plates of corresponding mounting frames are aligned, and wherein the top surfaces of the top plates of the corresponding mounting frames are aligned.

10. A method of hoisting and assembling a pre-fabricated reinforcement cage structure, the method comprising the following steps:

(a) providing a pre-fabricated reinforcement cage, the pre-fabricated reinforcement cage comprising:

a plurality of rebars; and a plurality of stirrups binding to outer circumferences of and fixed to the plurality of rebars, the plurality of stirrups being spaced apart along a length direction of the rebars so that the plurality of rebars are substantially parallel to each other;

(b) providing a first rebar-mounting frame comprising:

a first top plate having a plurality of notches formed along an edge of the first top plate;

a first bottom plate, wherein a first end portion of each of the plurality of rebars abuts against a first top surface of the first bottom plate; and a first lateral plate to which each of the first top plate and the bottom plate is connected;

(c) inserting the first end portion of each of the plurality of rebars into each of corresponding notches of the first rebar-mounting frame, and detachably securing the first end portion of each of the plurality of rebars to the first rebar-mounting frame through a coupler, thereby aligning first end surfaces of the first end portion of the plurality of rebars;

(d) providing a second rebar-mounting frame and detachably securing the second rebar-mounting frame to a second end portion of each of the plurality of rebars opposite to the first end of the plurality of rebars, the second rebar-mounting frame comprising at least one hook or hoist-ring mounted thereon;

(e) hoisting the pre-fabricated reinforcement cage structure to above a plurality of to-be-connected rebars;

(f) removing the first rebar-mounting frame from the pre-fabricated reinforcement cage structure and then adjusting a position of the pre-fabricated reinforcement cage structure so that each of the plurality of rebars of the pre-fabricated reinforcement cage structure is respectively aligned with and contacts a corresponding one of the plurality of the to-be-connected rebars; and (g) connecting and securing each of the plurality of rebars of the pre-fabricated reinforcement cage structure to a corresponding one of the plurality of the to-be-connected rebars through the coupler coupled to each of the plurality of rebars of the pre-fabricated reinforcement cage structure.

11. The method according to claim 10, wherein the coupler comprises a nut and a threaded sleeve, and wherein step (c) further includes: threadedly and sequentially coupling the nut and the threaded sleeve to a first threaded section of the first end portion of each of the plurality of rebars, and then adjusting positions of the nut and the threaded sleeve so that the nut and the threaded sleeve respectively abut against a first top surface and a bottom surface of the first top plate, thereby sandwiching the first top plate of the first rebar-mounting frame between the nut and the threaded sleeve.

12. The method according to claim 11, wherein the first rebar-mounting frame in step (b) is formed from a plurality of mounting frames assembled with each other, and wherein step (b) further includes: adjusting each of top surfaces of first bottom plates of corresponding mounting frames or adjusting top surfaces of first top plates of corresponding mounting frames so that top surfaces of first bottom plates or top surfaces of first top plates are aligned.

13. The method according to claim 10, wherein the first rebar-mounting frame in step (b) is formed from a plurality of mounting frames assembled with each other, and wherein step (b) further includes: adjusting each of top surfaces of first bottom plates of corresponding mounting frames or adjusting top surfaces of first top plates of corresponding mounting frames so that the top surfaces of first bottom plates or top surfaces of first top plates are aligned.

* * * * *